US006427955B1

(12) United States Patent
Sterner et al.

(10) Patent No.: US 6,427,955 B1
(45) Date of Patent: Aug. 6, 2002

(54) BAG LIFTING FRAME RETAINERS

(75) Inventors: Keith Sterner, Bath; John F. Simonof, Jr., Easton, both of PA (US); David R. Gill, Stewartsville, NJ (US)

(73) Assignee: Flexicon Corporation, Phillipsburg, NJ (US)

( * ) Notice: Subject to any disclaimer, the term of this patent is extended or adjusted under 35 U.S.C. 154(b) by 0 days.

(21) Appl. No.: 09/545,695

(22) Filed: Apr. 7, 2000

(51) Int. Cl.[7] ..... B65B 67/12

(52) U.S. Cl. ..... 248/100; 211/12; 294/81.56; 248/99

(58) Field of Search ..... 141/314, 315, 141/391; 248/95, 99, 100, 101, 316.2, 316.3, 340, 67.7, 74.2, 317, 322, 339; 24/555, 563, 562, 571; 220/495.08, 495.1, 495.11; 108/55.3, 55.5; 211/12

(56) References Cited

U.S. PATENT DOCUMENTS 1,359,586 A * 11/1920 Flagg ..... 177/160
1,528,454 A * 3/1925 Taggart et al. ..... 132/284
1,585,840 A * 5/1926 Fahnestock ..... 439/828
1,831,717 A * 11/1931 Muniente ..... 248/340
3,086,264 A * 4/1963 Tindall ..... 24/30.5 R
3,298,073 A * 1/1967 Merfeld ..... 24/555
3,561,077 A * 2/1971 Grant ..... 248/95
3,961,655 A * 6/1976 Nattrass et al. ..... 383/94
4,194,652 A * 3/1980 Williamson et al. ..... 222/181.3
D292,554 S * 11/1987 Yagi ..... D8/396
4,917,340 A * 4/1990 Juemann et al. ..... 248/74.3
4,946,065 A * 8/1990 Goulter et al. ..... 220/404
5,044,585 A * 9/1991 Breitenstein ..... 248/100
5,214,892 A * 6/1993 Livingston et al. ..... 52/222
5,232,186 A * 8/1993 Corkery ..... 248/97
5,269,579 A * 12/1993 DeCrane ..... 294/81.56

* cited by examiner

*Primary Examiner*—Leslie A. Braun
*Assistant Examiner*—Jonathon Szumny
(74) *Attorney, Agent, or Firm*—Volpe and Koenig, P.C.

(57) ABSTRACT

Bulk bag loop retainers used in conjunction with bulk bag lifting frames. Each retainer includes opposed retainer plates secured to the lifting frame. The plates are shaped and dimensioned and aligned relative to one another to define a non-linear passage into a retainment area which receives and retains the bag loop.

4 Claims, 4 Drawing Sheets

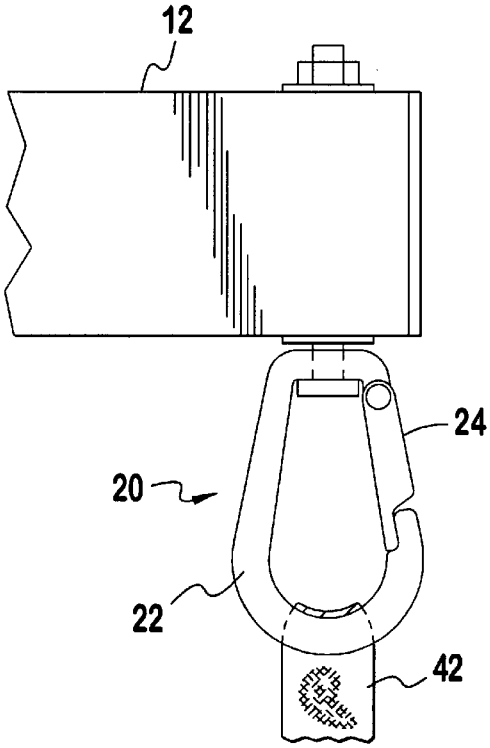
FIG. 1
PRIOR ART
FIG. 2
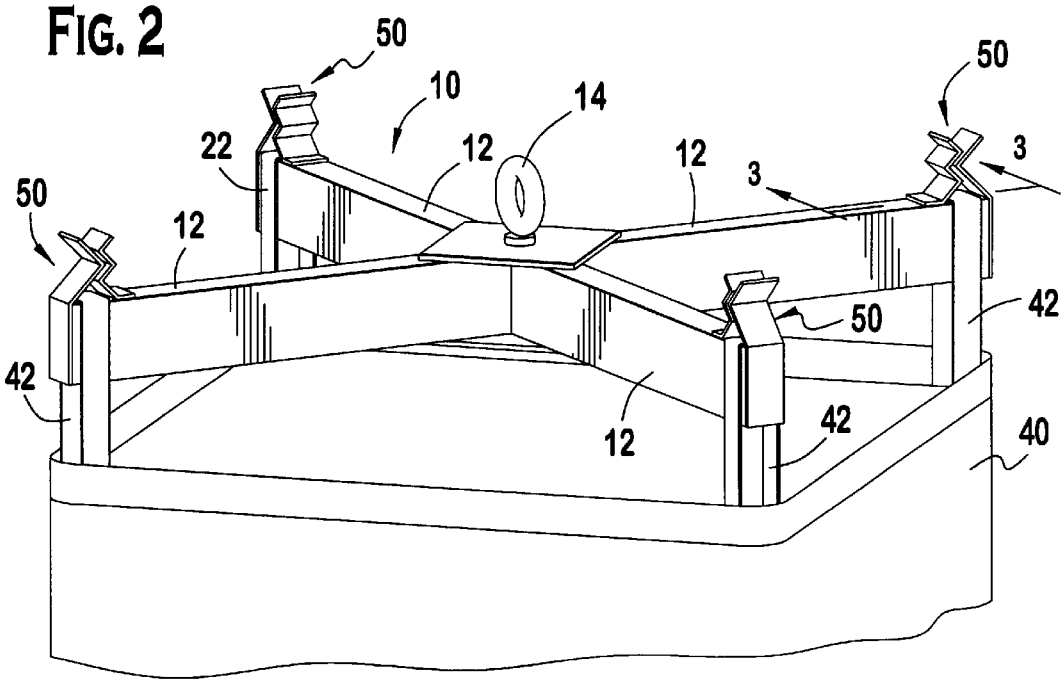

BAG LIFTING FRAME RETAINERS

BACKGROUND OF THE INVENTION

The present invention generally relates to bulk bag lifting frames. More particularly, the invention relates to retainers used in conjunction with bag lifting frames which permit easier loading and unloading of bags from the lifting frame.

Large bag like containers are often used for the shipment of bulk materials from one location to another. These bulk bags have a capacity ranging from approximately twenty cubic feet up to seventy cubic feet. The bulk bags are generally constructed with bag loops on the top of the bag which are connected to a lifting frame for holding the bags while they are being filled or emptied and occasionally for transporting the bags from one location to another. The bag loops are generally constructed of a strong web-like material which is sewn onto the upper corners of the bag.

The bag lifting frames generally comprise a system of horizontal frame members adapted to be supported by a hoist (See FIG. 2) or a fork lift (See FIG. 7), or other support means. Most prior art bag lifting frames include hooks or clips for holding the bag loops. A representative prior art hook 20 is shown in FIG. 1. The hook 20 is mounted on the horizontal frame member 12 and includes a J-bend portion 22 which receives and supports the loop 42 and a clasp member 24 which closes the hook 20 to prevent inadvertent release of the bag loop 42. The clasp member 24 is generally biased to the closed position. During loading of a bag, the biased clasp member 24 gives to permit the loop 42 to be looped over the J-bend 22. While it may be possible to load a loop with one hand, the process often requires a second hand to prevent rotation of the clasp member 24 during loading. Additionally, the loop 42 must be aligned close to the center of the J-bend 22, otherwise the frame may be subject to undesirable side loads. To remove the loop 42, the clasp member 24 must be forced toward and maintained in an open position to permit the loop 42 to be removed. Such a process generally requires two hand operation, one hand to open the clasp member 24 and a second to lift the loop 42 out of the hook 20. While it may be possible to release a loop with one hand, such a process requires great dexterity and subjects the operator to possible pinching by the clasp or other dangers.

As such, there is a need for a loop retainer which allows easier loading and unloading of a bag loop.

SUMMARY

The present invention relates to bag loop retainers used in conjunction with bulk bag lifting frames. The retainers include opposed first and second retainer plates which are secured to the lifting frame. The plates are aligned relative to one anther such that a projecting portion of one of the plates nests within an receiving portion of the other plate. The plates thereby define a non-linear passage into a retainment area which receives and retains the bag loop. In the preferred embodiment, the plates are configured such that the passage has a zig-zag configuration. passage has a zig-zag configuration.

BRIEF DESCRIPTION OF THE DRAWINGS

FIG. 1 is a side elevation of a prior art loop hook.

FIG. 2 is an isometric view of a bag lifting frame incorporating the loop retainers of the present invention.

DETAILED DESCRIPTION OF THE PREFERRED EMBODIMENTS

Figure 3:
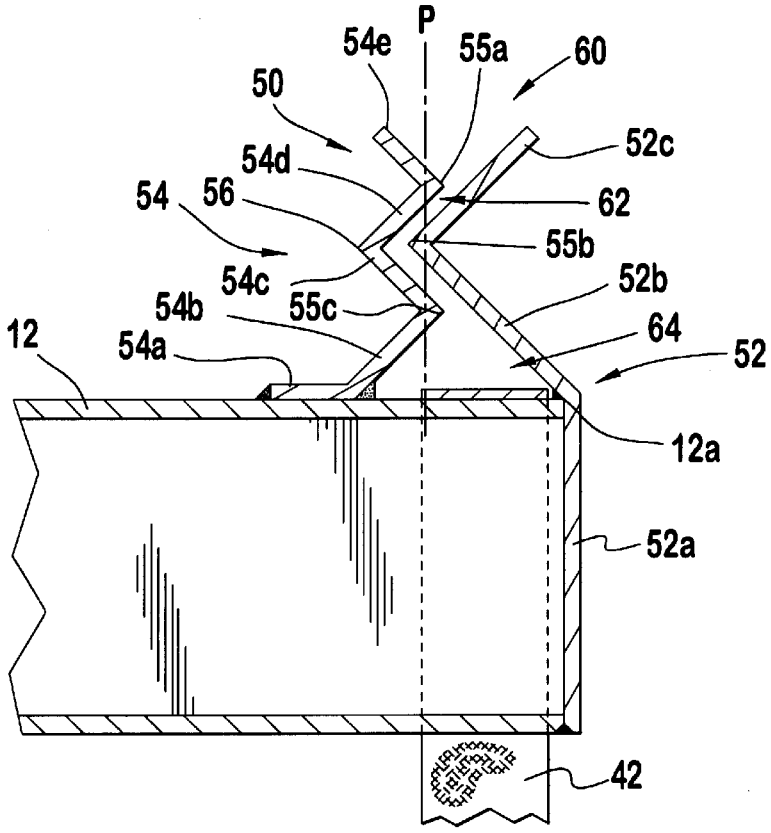
FIG. 3 is a view along the line 3—3 in FIG. 2.

The preferred embodiments will be described with reference to the drawing figures wherein like numerals represent like elements throughout.

Referring to FIG. 2, a hoist type lifting frame 10 is shown holding a bulk bag 40 by bag loops 42. The lifting frame 10 includes a plurality of horizontal frame members 12, an eye bolt 14 for attachment to a hoist cable (not shown), and a plurality of loop retainers 50. The horizontal frame members 12 are configured such that the loop retainers 50 are positioned proximate to the positions of the bag loops 42.

Referring to FIG. 3, each loop retainer 50 includes a pair of opposed retainer plates 52 and 54 which define chute opening 60, passageway 62, and retainment area 64. As will be described in more detail hereinafter, the chute opening 60 has sloped edges which direct the loop strap 42 toward the passageway 62 which preferably has a zig-zag configuration to reduce the likelihood of inadvertent release from the retainment area 64. The retainer plates 52 and 54 are positioned relative to one another such that the passageway 62 is an approximately one-quarter inch gap between the plates 52 and 54. The gap can be increased or decreased depending on the desired application.

Retainer plate 52 includes an attachment portion 52*a* and two bend portions 52*b*, 52*c*. The attachment portion 52*a* is preferably welded to the end of the horizontal frame member 12. Other attachment means, for example, bolts or screws, may also be used. Additionally, although it is preferable to position retainer plate 52 at the end of horizontal frame member 12, other positioning is contemplated depending on the demands of a particular application. The first bend portion 52*b* of retainer plate 52 extends up from the attachment portion 52*a* at an inward angle toward retainer plate 54 such that it is at an acute angle relative to the upper surface 12*a* of the horizontal frame member 12. The second bend portion 52*c* of retainer plate 52 extends outward, away from retainer plate 54, at a substantially right angle relative to the first bend portion 52*b*.

Retainer plate 54 includes an attachment portion 54*a* and four bend portions 54*b*, 54*c*, 54*d*, 54*e*. The attachment portion 54*a* is preferably welded to the upper surface 12*a* of the horizontal frame member 12. Again, other attachment means may also be used. The first bend portion 54*b* of retainer plate 54 extends up from the attachment portion 54*a* at an inward angle, toward retainer plate 52, such that it is also at an acute angle relative to the upper surface 12*a* of the horizontal frame member 12. The second bend portion 54*c* of retainer plate 54 extends outward, away from retainer plate 52, at a substantially right angle relative to the first bend portion 54*b*. The third bend portion 54*d* of retainer plate 54 extends inward, toward retainer plate 52, at a substantially right angle relative to the second bend portion 54*c*. The fourth bend portion 54*e* of retainer plate 54 extends outward, away from retainer plate 52, at a substantially right angle relative to the third bend portion 54*d*.

The retainer plates 52 and 54 are sized and positioned such that the retainment area 64 is defined by a portion of retainer plate 52 first bend portion 52*b* and retainer plate 54 first bend portion 54*b*. The passageway 62 is defined by both bend portions 52*b* and 52*c* of retainer plate 52 and second and third bend portions 54*c* and 54*d* of retainer plate 54. The angling of the various portions and the relative size and positioning defines three inward projections 55*a*, 55*b*, 55*c* and an indentation 56 which create the zig-zag of passageway 62. Projection 55*b* is nested in the indentation 56, that is, the projection 55*b*, extends into the indentation 56 such that an imaginary vertical plane P extends through portions 54*c* and 54*d* defining the indentation 56 and through portions 52*b* and 52*c* defining projection 55*b*. The chute opening 60 is defined by the second bend portion 52*c* of retainer plate 52 and the fourth bend portion 54*e* of retainer plate 54. The chute opening 60 funnels toward the passageway 62 to direct the loop strap 42 into the passageway 62 and ultimately the retainment area 64.

The retainer plates 52, 54 are preferably manufactured from one-quarter inch thick, two inch wide steel flat bar and may be formed with their desired configurations or may be configured after forming. Other materials may also be used. The plates 52, 54 are preferably rigid to maintain structural integrity.

Figure 4:
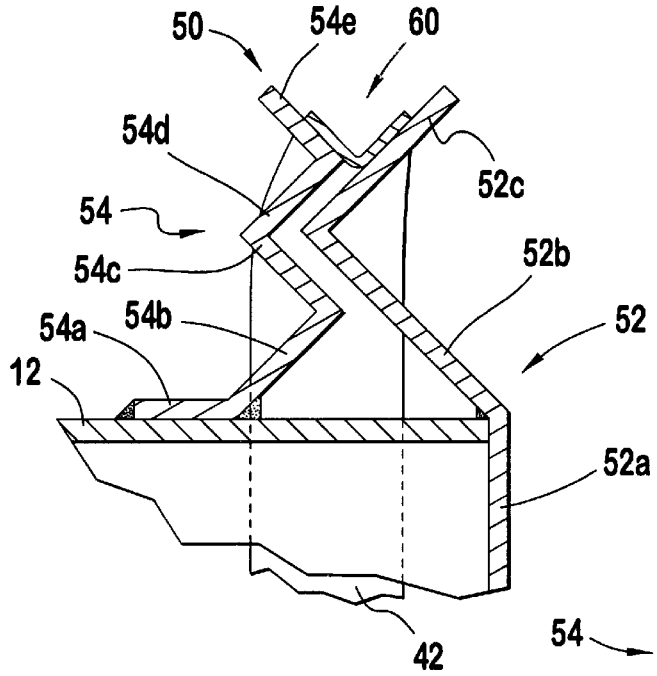
FIGS. 4–6 are section views similar to FIG. 3 illustrating the progression of a bag loop being loaded into one of the loop retainers of the present invention.
Figure 5:
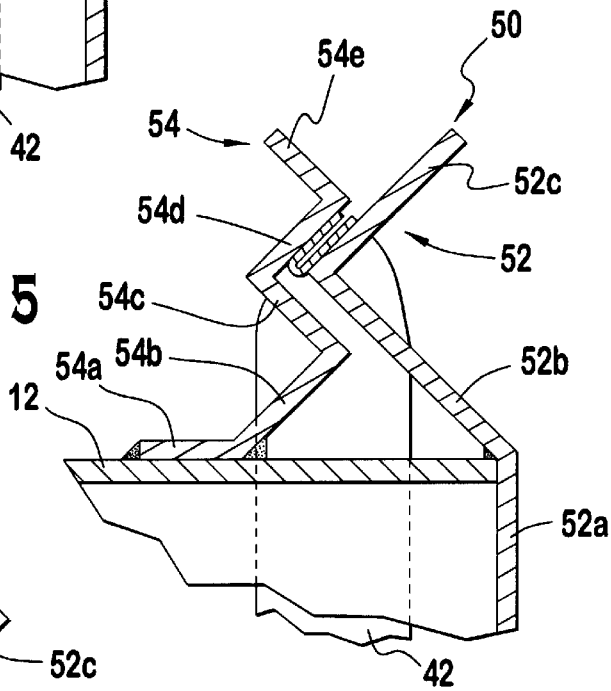
Figure 6:
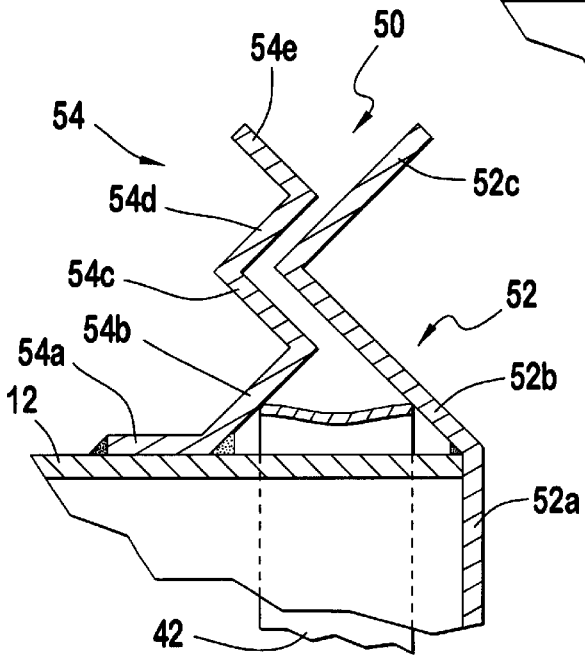

Referring to FIGS. 4–6, the progression of a bag loop 42 being loaded within a retainer 50 is shown. The loop is placed over the chute opening 60 and pulled down thereon. As explained above, the bend portions 52*c* and 54*e* define chute opening 60 with a funnel like configuration which directs the loop 42 toward passageway 62. As the loop is pulled through the chute opening 60, the funnel shape causes the loop 42 to begin folding upon itself as illustrated in FIG. 4. As the loop travels further into the passageway 62, it folds further upon itself, as illustrated in FIG. 5, thereby permitting the loop strap 42 to pass through the passageway 62. As the loop 42 travels into the retainment area 64, it relaxes as illustrated in FIG. 6 and is positioned within the retainment area 64. With the zig-zag passageway 62, slacking of the loop 42 will not permit the loop 42 to release from the retainer 50. Even if however, the loop 42 were to partially release, weighting of the bag or other tensioning of the loop 42 would simply cause the loop 42 to travel back through the passageway 62 into the retainment area 64. To remove the loop 42, the loop 42 is lifted with sufficient force to fold the loop 42 upon itself as it travels out of the retainer 50 in a manner similar to its entry. This generally can be accomplished with one hand. In the preferred configuration shown, the opening into the passageway 62 and the passageway 62 itself are identical whether travel is into the retainment area 64 or out of the retainer 50, that is, opposed surfaces in a funnel-like configuration leading to a zig-zagging passageway.

Figure 7:
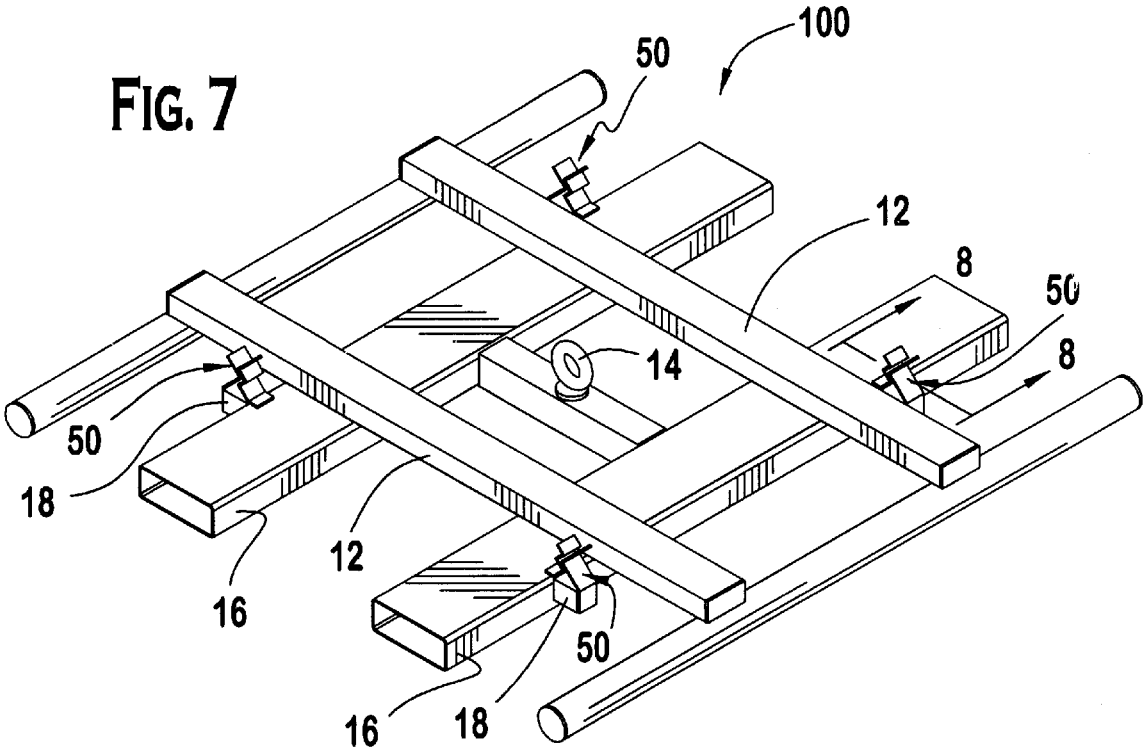
FIG. 7 is an isometric view of an alternate lifting frame incorporating loop retainers of the present invention.
Figure 8:
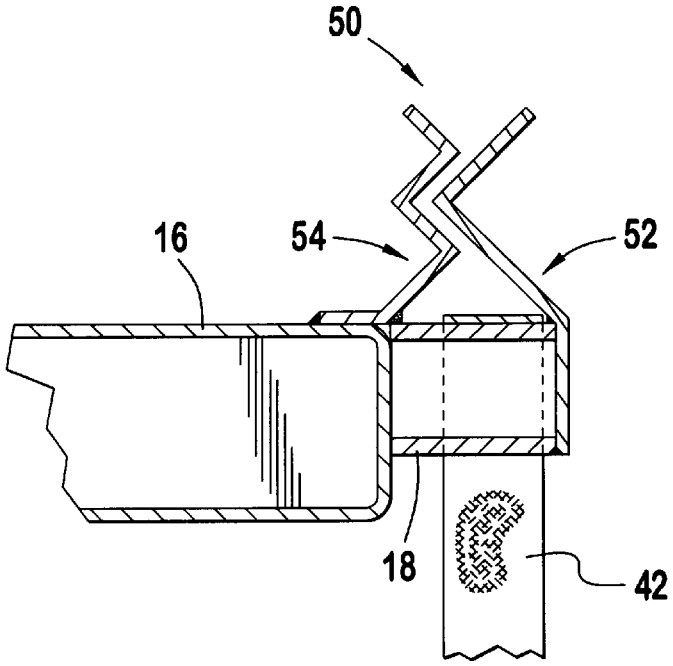
FIG. 8 is a view taken along the line 8—8 in FIG. 7.

Referring to FIGS. 7 and 8, the preferred retainers 50 are shown in use with an alternate lifting frame 100. The lifting frame 100 includes a plurality of horizontal frame members 12 and may include an eye bolt 14. The frame 100 further includes two channels 16 for receiving fork lift tines (not shown). The retainers 50 are substantially as described above, but are each attached to a channel 16 and a member 18 extending therefrom. Otherwise, the retainers 50 operate as described above.

Figure 9:
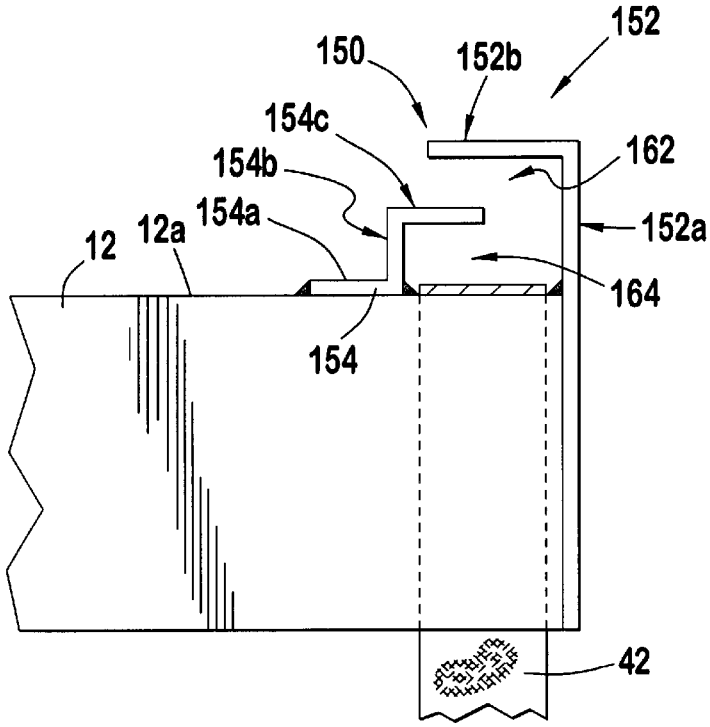
FIG. 9 is a side elevation of an alternative loop retainer of the present invention.

Referring to FIG. 9, an alternative embodiment of the retainer 150 is shown. The retainer 150 includes a pair of opposed retainer plates 152 and 154 which define passageway 162 and retainment area 164. The retainer plates 152 and 154 are positioned relative to one another such that the passageway 162 is an approximately one-quarter inch gap between the plates 152 and 154. Again, the gap can be increased or decreased depending on the desired application.

Retainer plate 152 includes an attachment portion 152*a* and a bend portion 152*b*. The attachment portion 152*a* is preferably welded to the end of the horizontal frame member 12. Other attachment means may also be used. The bend portion 152*b* of retainer plate 152 extends perpendicularly from the attachment portion 152*a* inward toward retainer plate 154 Retainer plate 154 includes an attachment portion 154*a* and two bend portions 154*b*, 154*c*. The attachment portion 154*a* is preferably welded to the upper surface 12*a* of the horizontal frame member 12. Again, other attachment means may also be used. The first bend portion 154*b* of retainer plate 154 extends up from the attachment portion 154*a* perpendicular thereto and the upper surface 12*a* of the horizontal frame member 12. The second bend portion 154*c* of retainer plate 154 extends perpendicular to the first bend portion 154*b* toward retainer plate 152.

The retainer plates 152 and 154 are sized and positioned such that the retainment area 164 is defined by a portion of retainer plate 152 attachment portion 152*a* and retainer plate 154 first and second bend portions 154*b* and 154*c*. The passageway 62 is defined by the attachment.and bend portions 152*a* and 152*b* of retainer plate 152 and the second bend portion 154*c* of retainer plate 154. The relative size and positioning of the retainer plates 152 and 154 is such that bend portions 152*b* and 154*c* overlap to define the passageway 162, with bend portion 154*c* sufficiently proximate attachment portion 152*a* to maintain the loop in the retainment area 164. The 42 loop can be loaded and unloaded by moving it through the passageway 162.

What is claimed is:

1. A bag lifting frame including a substantially planar surface portion and at least one bag loop retainer secured to the frame adjacent the substantially planar surface portion, the bag loop retainer comprising:

a first retainer plate including at least first, second and third portions, the first portion extending at an acute angle relative to the surface portion and the second and third portions angled relative to one another to define at least one indented portion;

a second retainer plate including at least a first portion extending at an acute angle relative to the surface portion and a second portion extending from and angled relative to the second plate first portion to define at least one projecting portion;

the first and second plates secured relative to the surface portion with the projecting portion nested within the indented portion such that they define a zig-zag passage into a retainment area defined by the surface portion and the first and second plate first portions.

2. The bag lifting frame of claim 1 wherein the first retainer plate has a fourth portion extending from and angled relative to the third portion and the first retainer plate fourth portion and a portion of the second retainer plate second portion define a chute into the passage.

3. The bag lifting frame of claim 1 further comprising a an eye bolt adapted for attachment to a hoist lifting cable.

4. The bag lifting frame of claim 1 further comprising spaced apart channels adapted to receive fork lift tines.

* * * * *